US010351785B2

(12) United States Patent
Koseoglu

(10) Patent No.: US 10,351,785 B2
(45) Date of Patent: Jul. 16, 2019

(54) INTEGRATED ISOMERIZATION AND HYDROTREATING APPARATUS

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/156,393

(22) Filed: Oct. 10, 2018

(65) Prior Publication Data

US 2019/0071609 A1 Mar. 7, 2019

Related U.S. Application Data

(62) Division of application No. 13/559,802, filed on Jul. 27, 2012, now Pat. No. 10,100,261.

(Continued)

(51) Int. Cl.

*C10G 67/00* (2006.01)
*C10G 67/06* (2006.01)

(Continued)

(52) U.S. Cl.

CPC ..... *C10G 25/00* (2013.01); *C10G 45/58* (2013.01); *C10G 65/00* (2013.01); *C10G 65/043* (2013.01);

(Continued)

(58) Field of Classification Search

CPC ..... C10G 25/00; C10G 67/00; C10G 65/00; C10G 65/043; C10G 65/16; C10G 45/58;

(Continued)

(56) References Cited

U.S. PATENT DOCUMENTS 4,359,596 A 11/1982 Howard et al.
4,447,315 A 5/1984 Lamb et al.

(Continued)

FOREIGN PATENT DOCUMENTS

CN 101117594 A1 2/2008
WO 2005056728 A2 6/2005
WO 2006088314 A1 8/2006

OTHER PUBLICATIONS

Hansford, Roland C., Ward, John W., "The Nature of Active Sites on Zeolites, VII. Relative Activities of Crystalline and Amorphous Alumino-Silicates", Journal of Catalysis, vol. 13, (1969), 316-320.

(Continued)

*Primary Examiner* — Randy Boyer
*Assistant Examiner* — Juan C Valencia
(74) *Attorney, Agent, or Firm* — Abelman, Frayne & Schwab

(57) ABSTRACT

Deep desulfurization of hydrocarbon feeds containing undesired organosulfur compounds to produce a hydrocarbon product having low levels of sulfur, i.e., 15 ppmw or less of sulfur, is achieved by with an apparatus arranged for flashing the feed at a target cut point temperature to obtain two fractions. A low boiling temperature fraction contains refractory, sterically hindered sulfur-containing compounds, which have a boiling point at or above the target cut point temperature. A high boiling temperature fraction, having a boiling point below the target cut point temperature, is substantially free of refractory sulfur-containing compounds. The high boiling temperature fraction is contacted with isomerization catalyst, and the isomerized effluent and the low boiling temperature fraction are combined and contacted with a hydrotreating catalyst in a hydrodesulfurization reaction zone operating under mild conditions to (Continued)

reduce the quantity of organosulfur compounds to an ultra-low level.

1 Claim, 2 Drawing Sheets

Related U.S. Application Data

(60) Provisional application No. 61/513,127, filed on Jul. 29, 2011.

(51) Int. Cl.

| | |
|---|---|
| ***C10G 67/16*** | (2006.01) |
| ***C10G 25/00*** | (2006.01) |
| ***C10G 65/16*** | (2006.01) |
| ***C10G 65/04*** | (2006.01) |
| ***C10G 65/00*** | (2006.01) |
| ***C10G 45/58*** | (2006.01) |

(52) U.S. Cl.
CPC ..... *C10G 65/16* (2013.01); *C10G 67/00* (2013.01); *C10G 67/06* (2013.01); *C10G 67/16* (2013.01); *C10G 2300/1059* (2013.01); *C10G 2300/202* (2013.01); *C10G 2300/301* (2013.01)

(58) Field of Classification Search
CPC .. C10G 67/06; C10G 67/16; C10G 2300/202; C10G 2300/1059; C10G 2300/301
See application file for complete search history.

(56) References Cited

U.S. PATENT DOCUMENTS

| | | | | |
|---|---|---|---|---|
| 4,592,832 | A | 6/1986 | Bristow et al. | |
| 4,851,109 | A | 7/1989 | Chen et al. | |
| 4,909,927 | A | 3/1990 | Bell | |
| 5,004,853 | A | 4/1991 | Barger et al. | |
| 5,011,593 | A | 4/1991 | Ware et al. | |
| 5,021,143 | A | 6/1991 | Franckowiak et al. | |
| 5,110,445 | A | 5/1992 | Chen et al. | |
| 5,124,023 | A | 6/1992 | Bosserman et al. | |
| 5,190,633 | A | 3/1993 | Fetzer et al. | |
| 5,290,427 | A | 3/1994 | Fletcher et al. | |
| 5,360,534 | A * | 11/1994 | Rice | C07C 9/14 208/139 |
| 5,409,599 | A | 4/1995 | Harandi | |
| 5,536,391 | A | 7/1996 | Howley et al. | |
| 5,880,325 | A | 3/1999 | Alward et al. | |
| 5,897,768 | A | 4/1999 | McVicker et al. | |
| 6,113,775 | A | 9/2000 | Christolini et al. | |
| 6,171,478 | B1 | 1/2001 | Cabrera et al. | |
| 6,248,230 | B1 | 6/2001 | Min et al. | |
| 6,676,829 | B1 | 1/2004 | Angevine et al. | |
| 6,866,772 | B2 | 3/2005 | Selai et al. | |
| 6,929,738 | B1 | 8/2005 | Riley et al. | |
| 7,374,666 | B2 | 5/2008 | Wachs | |
| 7,431,827 | B2 | 10/2008 | Rock et al. | |
| 7,731,838 | B2 | 6/2010 | McConnachie et al. | |
| 2004/0035752 | A1 | 2/2004 | Marchal-George et al. | |
| 2005/0218039 | A1 * | 10/2005 | Kalnes | C10G 65/00 208/210 |
| 2006/0213809 | A1 | 9/2006 | Barthelet et al. | |
| 2008/0093260 | A1 | 4/2008 | Koseoglu | |
| 2008/0105595 | A1 | 5/2008 | Koseoglu | |
| 2008/0116112 | A1 | 5/2008 | Umansky et al. | |
| 2008/0308463 | A1 | 12/2008 | Keckler et al. | |
| 2009/0065398 | A1 | 3/2009 | McConnachie et al. | |
| 2009/0084709 | A1 | 4/2009 | Choi | |
| 2009/0107890 | A1 | 4/2009 | Hamad et al. | |
| 2009/0145807 | A1 | 6/2009 | Choi et al. | |
| 2012/0024751 | A1 | 2/2012 | He | |

OTHER PUBLICATIONS

Isoda, Takaai, Nagao, Shinichi, Ma, Xiaoliang, Korai, Yozo, Mochida, Isao "Hydrodesulfurization Pathway of 4,6-Dimethyldibenzothiophene through Isomerization over Y-Zeolite Containing CoMo/A12O3 Catalyst." Energy Fuels, 1996, 10, 1078-1082.

Isoda, Takaai, Takase, Yoyoto, Kusakabe, Katsuki, Morooka, Shigeharu. "Changes in Desulfurization Reactivity of 4,6-Dimethyldibenzothiophene by Skeletal Isomerization Using a Ni-Supported Y-Type Zeolite." Energy Fuels, 2000, vol. 14, 585-590.

M.V. Landau et al., "Tail-Selective Hydrocracking of Heavy Gas Oil in Diesel Production." Studies in Surface Science and Catalysis, vol. 106, 1997, 371-378.

Petr Steiner et al., "Catalytic hydrodesulfurization of a light gas oil over a NiMo catalyst: kinetics of selected sulfur components." Fuel Processing Technology, vol. 79, Issue 1, Aug. 2, 2002, 1-12.

Ruixiang Hua et al., "Determination of sulfur-containing compounds in diesel oils by comprehensive two-dimensional gas chromatography with a sulfur chemiluminescence detector." Journal of Chromatography, vol. 1019, Issues 1-2, Nov. 2003, 101-109.

International Search Report and Written Opinion, PCT/US2012/048462, dated May 24, 2013 (13 pages).

CN201280045985.9, First Office Action dated Dec. 3, 2014, 15 pages.

CN201280045985.9, Second Office Action dated Jul. 29, 2015, 16 pages.

CN201280045985.9, Third Office Action dated Feb. 14, 2016, 11 pages.

CN201280045985.9, Rejection Decision dated Aug. 30, 2016, 10 pages.

CN201280045985.9, Notification of Reexamination dated Apr. 6, 2017, 11 pages.

* cited by examiner

INTEGRATED ISOMERIZATION AND HYDROTREATING APPARATUS

RELATED APPLICATIONS

This application is a divisional application of U.S. Non-Provisional patent application Ser. No. 13/559,802 filed Jul. 27, 2012, which claims priority to U.S. Provisional Patent Application No. 61/513,127 filed Jul. 29, 2011, the contents of which both are incorporated herein by reference.

BACKGROUND OF THE INVENTION

Field of the Invention

The present invention relates to hydrotreating processes to efficiently reduce the sulfur content of hydrocarbons.

Description of Related Art

The discharge into the atmosphere of sulfur compounds during processing and end-use of the petroleum products derived from sulfur-containing sour crude oil poses health and environmental problems. Stringent reduced-sulfur specifications applicable to transportation and other fuel products have impacted the refining industry, and it is necessary for refiners to make capital investments to greatly reduce the sulfur content in gas oils to 10 parts per million by weight (ppmw) or less. In the industrialized nations such as the United States, Japan and the countries of the European Union, refineries have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the footsteps of the United States and the European Union and are moving forward with regulations that will require refineries to produce transportation fuels with ultra-low sulfur levels.

To keep pace with recent trends toward production of ultra-low sulfur fuels, refiners must choose among the processes or crude oils that provide flexibility that ensures future specifications are met with minimum additional capital investment, in many instances by utilizing existing equipment. Conventional technologies such as hydrocracking and two-stage hydrotreating offer solutions to refiners for the production of clean transportation fuels. These technologies are available and can be applied as new grassroots production facilities are constructed. However, many existing hydroprocessing facilities, such as those using relatively low pressure hydrotreaters, represent a substantial prior investment and were constructed before these more stringent sulfur reduction requirements were enacted. It is very difficult to upgrade existing hydrotreating reactors in these facilities because of the comparatively more severe operational requirements (i.e., higher temperature and pressure) to obtain clean fuel production. Available retrofitting options for refiners include elevation of the hydrogen partial pressure by increasing the recycle gas quality, utilization of more active catalyst compositions, installation of improved reactor components to enhance liquid-solid contact, the increase of reactor volume, and the increase of the feedstock quality.

There are many hydrotreating units installed worldwide producing transportation fuels containing 500-3000 ppmw sulfur. These units were designed for, and are being operated at, relatively mild conditions (i.e., low hydrogen partial pressures of 30 kilograms per square centimeter for straight run gas oils boiling in the range of from 180° C. to 370° C.).

With the increasing prevalence of more stringent environmental sulfur specifications in transportation fuels mentioned above, the maximum allowable sulfur levels are being reduced to no greater than 15 ppmw, and in some cases no greater than 10 ppmw. This ultra-low level of sulfur in the end product typically requires either construction of new high pressure hydrotreating units, or a substantial retrofitting of existing facilities, e.g., by incorporating gas purification systems, reengineering the internal configuration and components of reactors, and/or deployment of more active catalyst compositions.

Sulfur-containing compounds that are typically present in hydrocarbon fuels include aliphatic molecules such as sulfides, disulfides and mercaptans as well as aromatic molecules such as thiophene, benzothiophene and its long chain alkylated derivatives, and dibenzothiophene and its alkyl derivatives such as 4,6-dimethyl-dibenzothiophene. Aromatic sulfur-containing molecules have a higher boiling point than aliphatic sulfur-containing molecules, and are consequently more abundant in higher boiling fractions.

In addition, certain fractions of gas oils possess different properties. Table 1 illustrates the properties of light and heavy gas oils derived from Arabian Light crude oil:

TABLE 1

| Feedstock Name | | Light | Heavy |
|---|---|---|---|
| API Gravity | ° | 37.5 | 30.5 |
| Carbon | W % | 85.99 | 85.89 |
| Hydrogen | W % | 13.07 | 12.62 |
| Sulfur | W % | 0.95 | 1.65 |
| Nitrogen | ppmw | 42 | 225 |
| ASTM D86 Distillation | | | |
| IBP/5 V % | ° C. | 189/228 | 147/244 |
| 10/30 V % | ° C. | 232/258 | 276/321 |
| 50/70 V % | ° C. | 276/296 | 349/373 |
| 85/90 V % | ° C. | 319/330 | 392/398 |
| 95 V % | ° C. | 347 | |
| Sulfur Speciation | | | |
| Organosulfur Compounds Boiling Less than 310° C. | ppmw | 4591 | 3923 |
| Dibenzothiophenes | ppmw | 1041 | 2256 |
| $C_1$-Dibenzothiophenes | ppmw | 1441 | 2239 |
| $C_2$-Dibenzothiophenes | ppmw | 1325 | 2712 |
| $C_3$-Dibenzothiophenes | ppmw | 1104 | 5370 |

As set forth above in Table 1, the light and heavy gas oil fractions have ASTM D85/90 V % point of 319° C. and 392° C., respectively. Further, the light gas oil fraction contains less sulfur and nitrogen than the heavy gas oil fraction (0.95 weight % or W % sulfur as compared to 1.65 W % sulfur and 42 ppmw nitrogen as compared to 225 ppmw nitrogen).

Advanced analytical techniques such as multi-dimensional gas chromatography (Hua R., Li Y., Liu W., Zheng J., Wei H., Wang J., LU X., Lu X., Kong H., Xu G., *Journal of Chromatography A,* 1019 (2003) 101-109) with a sulfur chemiluminescence detector have shown that the middle distillate cut boiling in the range of from 170° C. to 400° C. contains sulfur species including thiols, sulfides, disulfides, thiophenes, benzothiophenes, dibenzothiophenes, and benzonaphthothiophenes, with and without alkyl substituents.

The sulfur speciation and content of light and heavy gas oils are conventionally analyzed by two methods. In the first method, sulfur species are categorized based on structural groups. The structural groups include one group having sulfur-containing compounds boiling at less than 310° C., including dibenzothiophenes and its alkylated isomers, and another group including 1, 2 and 3 methyl-substituted dibenzothiophenes, denoted as $C_1$, $C_2$ and $C_3$, respectively. Based on this method, the heavy gas oil fraction contains more alkylated di-benzothiophene molecules than the light gas oils.

In the second method of analyzing sulfur content of light and heavy gas oils, and referring to FIG. 1, the cumulative sulfur concentrations are plotted against the boiling points of the sulfur-containing compounds to observe concentration variations and trends. Note that the boiling points depicted are those of detected sulfur-containing compounds, rather than the boiling point of the total hydrocarbon mixture. The boiling point of several refractory sulfur-containing compounds consisting of dibenzothiophenes, 4-methyldibenzothiophenes and 4,6-dimethyl-dibenzothiophenes are also shown in FIG. 1 for convenience. The cumulative sulfur specification curves show that the heavy gas oil fraction contains a higher proportion of heavier sulfur-containing compounds and lower proportion of lighter sulfur-containing compounds as compared to the light gas oil fraction. For example, it is found that 5370 ppmw of $C_3$-dibenzothiophene, and bulkier molecules such as benzonaphthothiophenes, are present in the heavy gas oil fraction, compared to 1104 ppmw in the light gas oil fraction. In contrast, the light gas oil fraction contains a higher content of light sulfur-containing compounds compared to heavy gas oil. Light sulfur-containing compounds are structurally less bulky than dibenzothiophenes and boil at less than 310° C. Also, twice as much $C_1$ and $C_2$ alkyl-substituted dibenzothiophenes exist in the heavy gas oil fraction as compared to the light gas oil fraction.

Aliphatic sulfur-containing compounds are more easily desulfurized (labile) using mild hydrodesulfurization methods. However, certain highly branched aromatic molecules can sterically hinder the sulfur atom removal and are moderately more difficult to desulfurize (refractory) using mild hydrodesulfurization methods.

Among the sulfur-containing aromatic compounds, thiophenes and benzothiophenes are relatively easy to hydrodesulfurize. The addition of alkyl groups to the ring compounds increases the difficulty of hydrodesulfurization. Dibenzothiophenes resulting from addition of another ring to the benzothiophene family are even more difficult to desulfurize, and the difficulty varies greatly according to their alkyl substitution, with di-beta substitution being the most difficult to desulfurize, thus justifying their "refractory" appellation. These beta substituents hinder exposure of the heteroatom to the active site on the catalyst.

The economical removal of refractory sulfur-containing compounds is therefore exceedingly difficult to achieve, and accordingly removal of sulfur-containing compounds in hydrocarbon fuels to an ultra-low sulfur level is very costly by current hydrotreating techniques. When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams.

Relative reactivities of sulfur-containing compounds based on their first order reaction rates at 250° C. and 300° C. and 40.7 Kg/cm$^2$ hydrogen partial pressure over Ni—Mo/alumina catalyst, and activation energies, are given in Table 2 (Steiner P. and Blekkan E. A., Fuel Processing Technology 79 (2002) 1-12).

TABLE 2

| Name | Dibenzothiophene | 4-methyl-dibenzo-thiophene | 4,6-dimethyl-dibenzo-thiophene |
|---|---|---|---|
| Structure | 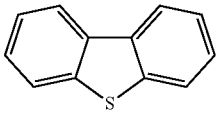 | 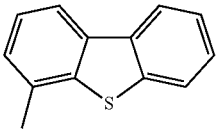 | 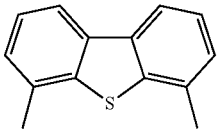 |
| Reactivity $k_{@250}$, $s^{-1}$ | 57.7 | 10.4 | 1.0 |
| Reactivity $k_{@300}$, $s^{-1}$ | 7.3 | 2.5 | 1.0 |
| Activation Energy $E_a$, Kcal/mol | 28.7 | 36.1 | 53.0 |

As is apparent from Table 2, dibenzothiophene is 57 times more reactive than the refractory 4, 6-dimethyldibenzothiophene at 250° C. The relative reactivity decreases with increasing operating severity. With a 50° C. temperature increase, the relative reactivity of di-benzothiophene compared to 4,6-dimethyl-dibenzothiophene decreases to 7.3 from 57.7.

Studies have been conducted related to increasing the relative reactivity of sterically hindered sulfur-containing hydrocarbons. In particular, isomerization of 4,6-dimethyldibenzothiophene into methyl-migrated isomers and tri- or tetramethyl-dibenzothiophenes was studied. See Isoda et al., "Hydrodesulfurization Pathway of 4,6-Dimethyldibenzothiophene through Isomerization over Y-Zeolite Containing $CoMo/Al_2O_3$ Catalyst", *Energy & Fuels,* 1996, 10, 1078-1082, and Isoda et al., "Changes in Desulfurization Reactivity of 4,6-Dimethyldibenzothiophene by Skeletal Isomerization Using a Ni-Supported Y-Type Zeolite," *Energy & Fuels,* 2000, 14, 585-590.

McConnachie, et al. U.S. Pat. No. 7,731,838 describes a process in which a diesel boiling range feedstream which includes nitrogen-containing compounds and hindered dibenzothiophenes is subjected to removal of nitrogen-containing compounds by contacting the feedstream with a sulfuric acid solution, contacting the reduced nitrogen stream with a solid acid catalyst to isomerize certain sulfur-containing molecules; and hydrotreating the isomerized effluent. However, the described process in McConnachie, et al. prefers that the entire feed is both subjected to the removal of nitrogen-containing compounds by contacting the feedstream with a sulfuric acid solution, and contacted with the costly and sensitive (i.e., easily poisoned) solid acid isomerization catalyst. This requires that the nitrogen-removal apparatus have a capacity suitable for the entire feedstream, and impart excessive demand on this isomerization catalyst and its reactor capacity.

McVicker, et al. U.S. Pat. No. 5,897,768 teaches a desulfurization process in which an entire feedstream is hydrotreated using conventional catalysts. The partially hydrotreated effluent is fractionated, whereby sterically hindered sulfur-containing hydrocarbons are removed with the bottoms stream. The bottoms stream is passed to a reactor containing isomerization catalyst. The effluent from the reactor containing isomerization catalyst is returned to the hydrotreating reactor. However, in McVicker, et al., the entire initial feed is passed through the hydrotreating reactor, including refractory sulfur-containing hydrocarbons which are likely not desulfurized in this initial pass-through, thus decreasing the overall process efficiency.

Therefore, a need exists for improved process and apparatus for desulfurization of hydrocarbon fuels to an ultra-low sulfur level.

Accordingly, it is an object of the present invention to desulfurize a hydrocarbon fuel stream containing different classes of sulfur-containing compounds having different reactivities.

SUMMARY OF THE INVENTION

In accordance with one or more embodiments, the invention relates to a system and method of hydrotreating hydrocarbon feedstocks to efficiently reduce the undesired organosulfur compounds.

In accordance with one or more embodiments, an integrated process for hydrotreating a feedstock is provided. The integrated process includes the steps of:

a. fractioning the hydrocarbon feed at a temperature cut point in the range of from about 300° C. to about 360° C. to provide

- a low boiling temperature fraction that contains labile organosulfur compounds and
- a high boiling temperature fraction that contains sterically hindered refractory organosulfur compounds;

b. contacting the high boiling temperature fraction with an isomerization catalyst in the presence of hydrogen to remove steric hindrance of certain compounds and produce an isomerized effluent including isomerate and any remaining unreacted hydrogen;

c. subjecting the low boiling temperature fraction and the isomerized effluent to a mild hydrotreating process to thereby reduce the sulfur content; and d. recovering a hydrotreated hydrocarbon product.

As used herein, the terms "hydrotreating" and "hydrodesulfurizing," as well as variants of these terms, may be used interchangeably.

As used herein, the term "labile organosulfur compounds" means organosulfur compounds that can be easily desulfurized under relatively mild hydrodesulfurization pressure and temperature conditions, and the term "refractory organosulfur compounds" means organosulfur compounds that are relatively more difficult to desulfurize under mild hydrodesulfurization conditions.

Additionally, as used herein, the terms "mild hydrotreating," "mild operating conditions" and "mild conditions" (when used in reference to hydrotreating) means hydrotreating processes operating at temperatures of 400° C. and below, hydrogen partial pressures of 40 bars and below, and hydrogen feed rates of 500 standard liters of hydrogen per liter of oil (SLt/Lt), and below.

BRIEF DESCRIPTION OF THE DRAWINGS

The foregoing summary as well as the following detailed description will be best understood when read in conjunction with the attached drawings. It should be understood, however, that the invention is not limited to the precise arrangements and apparatus shown. In the drawings.

DETAILED DESCRIPTION OF THE INVENTION

Figure 1:
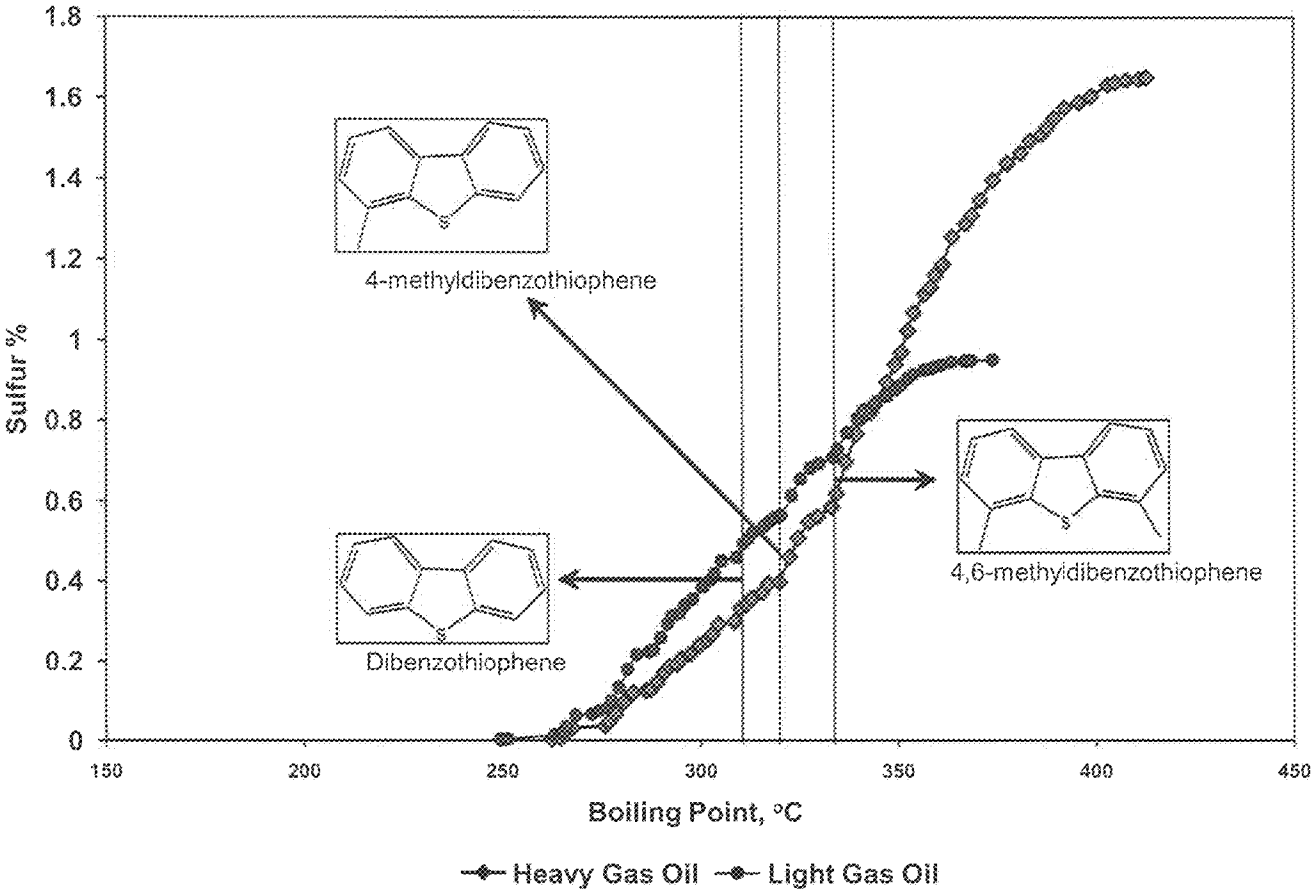
FIG. 1 PRIOR ART
FIG. 1 is a graph showing cumulative sulfur concentrations plotted against boiling points of three thiophenic compounds.

The above objects and further advantages are provided by the apparatus and process for desulfurization of hydrocarbon feeds containing both refractory and labile organosulfur compounds. A high boiling temperature fraction, in certain embodiments after adsorption to remove nitrogen-containing compounds, is passed to a reactor containing isomerization catalyst. The isomerized high boiling temperature fraction, and the low boiling temperature fraction (untreated), are combined and conveyed to a hydrotreating zone for desulfurization under mild operating conditions.

The integrated system and process is capable of efficiently and cost-effectively reducing the organosulfur content of hydrocarbon fuels. Deep desulfurization of hydrocarbon fuels effectively optimizes use of integrated apparatus and processes, combining mild hydrotreating, adsorption and catalytic isomerization. Refiners can use existing hydrotreating refinery unit operations under relatively mild conditions.

The inclusion of a fractioning step in an integrated system and process combining hydrodesulfurization and catalytic isomerization allows a partition of the different classes of sulfur-containing compounds according to their respective reactivity factors, thereby optimizing and economizing mild hydrotreating, adsorption and catalytic isomerization, and hence resulting in a more cost effective process. The volumetric/mass flow through the adsorption zone and catalytic isomerization zone is reduced, since only the fraction of the original feedstream containing refractory sulfur-containing compounds is subjected to these processes. As a result, the requisite equipment capacity, and accordingly both the capital equipment cost and the operating costs, are minimized.

Furthermore, product quality is improved by the integrated process herein since undesired side reactions associated with catalytic isomerization of the entire stream including labile hydrocarbons using solid acid catalysts are avoided.

An integrated desulfurization process is described for the production of hydrocarbon fuels with an ultra-low level of sulfur which includes the following steps:

a. fractioning the initial hydrocarbon feedstock at a target cut point temperature in the range of from about 300° C. to about 360° C., preferably about 340° C., to obtain two fractions, which contain different classes of organosulfur compounds having different reactivities when subjected to mild hydrotreating processes;

b. organosulfur compounds in the fraction boiling below the target cut point temperature are primarily labile organosulfur compounds, including aliphatic molecules such as sulfides, disulfides, mercaptans, and certain aromatics such as thiophenes and alkyl derivatives of thiophenes, and this fraction is directly passed to a hydrotreating zone operating under mild conditions to remove the organosulfur compounds, and c. the fraction boiling at or above the target cut point temperature, which contains organosulfur compounds that are primarily refractory organosulfur compounds, including aromatic molecules such as certain benzothiophenes (e.g., long chain alkylated benzothiophenes), dibenzothiophene and alkyl derivatives such as sterically hindered 4,6-dimethyldibenzothiophene, is passed to an isomerization reaction zone to convert sterically hindered refractory organosulfur compounds into isomers which are more reactive to hydrotreating under mild operating conditions, and the isomerized effluent is recycled to the mild hydrotreating process.

In hydrocarbon feeds that contain an undesirably high level of nitrogen-containing compounds, and in certain feeds undesirably high levels of poly-nuclear aromatic compounds, the high boiling fraction is contacted with an adsorbent material prior to entering the isomerization reaction zone.

Figure 2:
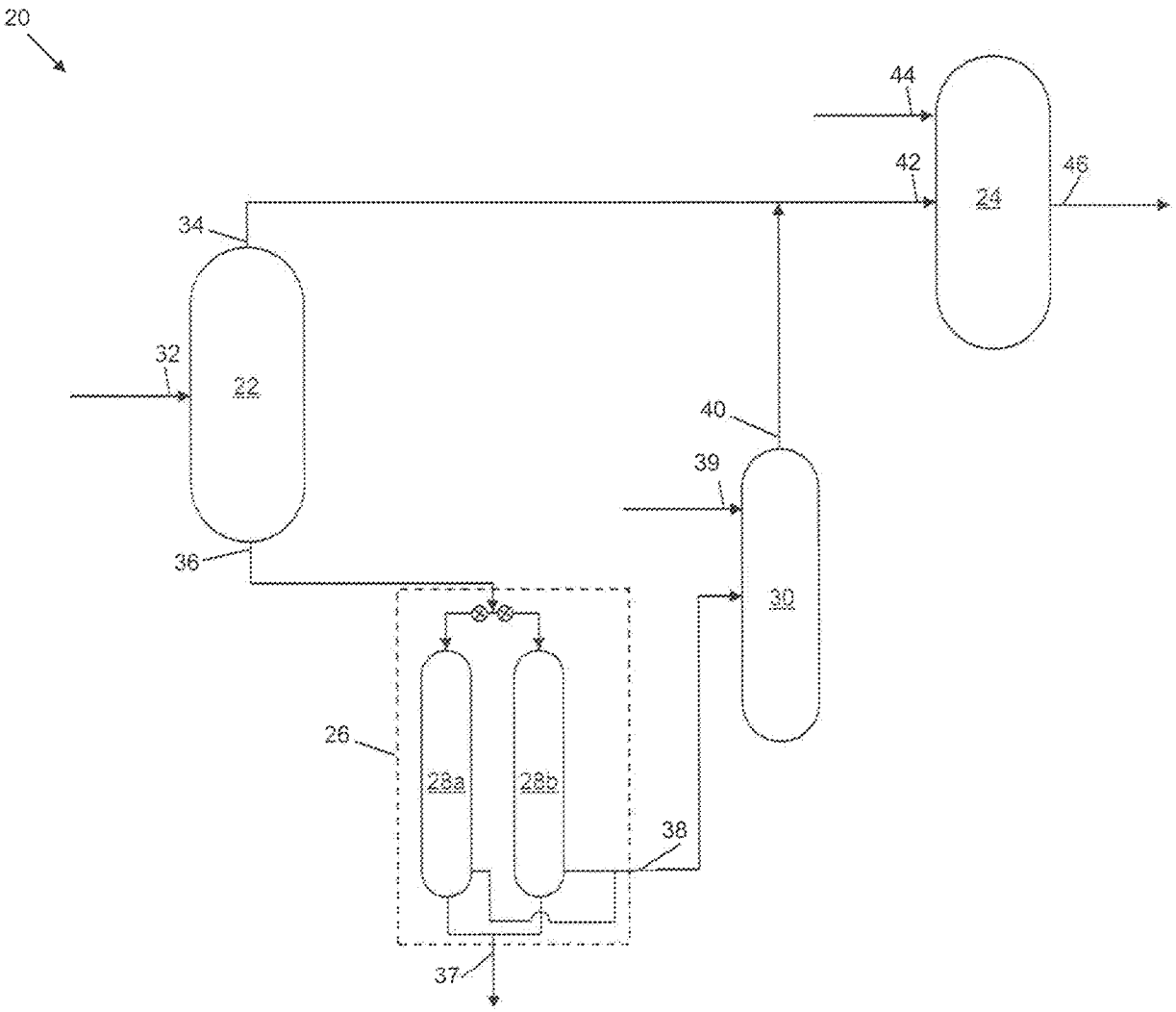
FIG. 2 is a schematic diagram of an integrated desulfurization system and process.

Referring to FIG. 2, an integrated desulfurization apparatus 20 is schematically illustrated. Apparatus 20 includes a fractionating or flashing unit 22, a hydrotreating or hydrodesulfurization reaction zone 24, an adsorption zone 26 and an isomerization reaction zone 30. Fractionating or flashing unit 22 includes a feed inlet 32, a low boiling temperature outlet 34 and a high boiling temperature outlet 36. Note that unit 22 can be a simple flash vessel or an atmospheric distillation column.

Note that while the embodiment of apparatus 20 described herein includes an adsorption zone, alternative embodiments can be practiced without the adsorption zone. For instance, certain feedstreams can be processed with contain a level of nitrogen and/or polynuclear aromatic compounds that does not significantly poison the isomerization catalyst in isomerization reaction zone 30.

Hydrodesulfurization reaction zone 24 includes an inlet 42 in fluid communication with low boiling temperature outlet 34, a hydrogen gas inlet 44 and a desulfurized product outlet 46. Inlets to adsorption units 28*a*, 28*b* of adsorption zone 26 are in selective fluid communication with high boiling temperature outlet 36, e.g., via one or more valves in a swing mode system. An outlet 38 of adsorption zone 26 is in fluid communication with an inlet to the isomerization reaction zone 30. An isomerized hydrocarbon outlet 40 of the isomerization reaction zone 30 is in fluid communication with inlet 42 of hydrodesulfurization reaction zone 24.

A hydrocarbon feedstream is introduced via inlet 32 of flashing unit 22 to be fractioned at a target cut point temperature in the range of from about 300° C. to about 360° C., and in certain embodiments at about 340° C., into two streams discharged from low boiling temperature outlet 34 and high boiling temperature outlet 36. The low boiling range fraction is combined with isomerized effluent from outlet 40 of the isomerization reaction zone 30 and conveyed to inlet 42 of hydrotreating reaction zone 24 and into contact with a hydrodesulfurization catalyst and hydrogen via inlet 44. The high boiling range fraction is conveyed to an inlet of adsorption zone 26 to reduce the concentration of certain contaminants including nitrogen-containing compounds and in certain embodiments poly-nuclear aromatic compounds.

The treated high boiling point effluent from outlet 38 is passed to the isomerization reaction zone 30 along with hydrogen via inlet 39 for isomerization reactions over an isomerization catalyst, such as an acid catalyst. The isomerized stream via outlet 40, including isomerate, unreacted hydrogen and any light gases formed in isomerization reaction zone 30, is combined with the low boiling range fraction and the combined stream is passed to the hydrotreating reaction zone 24 via inlet 42 and into contact with a hydrotreating catalyst and a hydrogen teed via inlet 44. Since sterically hindered sulfur-containing compounds are generally present in relatively low concentrations, if at all, in the combined stream to be desulfurized, hydrotreating reaction zone 24 can operate under mild conditions.

The resulting hydrocarbon stream via outlet 46 contains an ultra-low level of organosulfur compounds, i.e., less than 15 ppmw, and in certain embodiments less than 10 ppmw, since substantially all of the aliphatic organosulfur compounds and thiophenes are labile under mild hydrotreating conditions, and sterically hindered multi-ring aromatic organosulfur compounds such as benzothiophenes and their derivatives that were present in the initial feed were converted to more reactive isomers that can be removed under mild hydrotreating conditions. This hydrotreated hydrocarbon product can be blended, used as a feed, or subjected to further downstream refinery operations.

The initial feedstock for use in above-described apparatus and process can be a crude or partially refined oil product obtained from various sources. The source of feedstock can be crude oil, synthetic crude oil, bitumen, oil sand, shale oil, coal liquids, or a combination including one of the foregoing sources. For example, the feedstock can be a straight run gas oil or other refinery intermediate stream such as vacuum gas oil, deasphalted oil and/or demetalized oil obtained from a solvent deasphalting process, light coker or heavy coker gas oil obtained from a coker process, cycle oil obtained from an FCC process, gas oil obtained from a visbrcaking process, or any combination of the foregoing products. In certain embodiments, a suitable hydrocarbon feedstock is a straight run gas oil, a middle distillate fraction, or a diesel fraction, boiling in the range of from about 180° C. to about 450° C., in certain embodiments about 180° C. to about 400° C., and in further embodiments about 180° C. to about 370° C., typically containing up to about 2 W % sulfur and up to about 3,000 ppmw nitrogen. Nonetheless, one of ordinary skill in the art will appreciate that other hydrocarbon streams can benefit from the practice of the herein described system and method.

Adsorption zone 26 can include plural adsorption units 28*a*, 28*b*, such that swing-mode adsorption occurs as is known to one of ordinary skill in the art. During an adsorption cycle, one adsorption unit 28*a* is adsorbing contaminants from the feed and producing a treated high boiling point effluent stream discharged from outlet 38, while the other adsorption unit 28*b* is in the desorption cycle to desorb the previously adsorbed contaminants for removal in a discharge stream via an outlet 37. This discharge stream can be passed to an existing fuel oil pool, or to an existing cracking unit such as a hydrocracking unit, an FCC unit or a coking unit.

When the adsorbent material in column 28*a* or 28*b* becomes saturated with adsorbed contaminants, the flow of the combined feedstream is directed to the other column. The adsorbed compounds are desorbed by heat or solvent treatment.

In case of heat desorption, heat is applied, for instance, with an inert nitrogen gas flow to the desorbed adsorption column. The desorbed compounds are removed from the adsorption columns 28*a*, 28*b*, for instance, via outlet 37 or other suitable outlet.

In the case of solvent desorption, fresh or recycled solvent is introduced to the adsorption zone. The solvent stream containing removed nitrogen-containing compounds and/or poly-nuclear aromatic compounds is discharged from adsorption zone 26 via outlet 37, and solvent can be recovered using flash or distillation separation.

Nitrogen-containing compounds and in certain embodiments poly-nuclear aromatic compounds are removed in adsorption zone 26 to increase the useful lifetime of the isomerization catalysts. For instance, basic nitrogen-containing compounds are removed as they tend to poison the acidic isomerization catalysts. Examples of these basic nitrogen-containing compounds targeted in the adsorption zone 26 include acridines, quinolines, anilines, quinoline, indole, carbazole, quinolin-2(1H)-one, and derivatives of any of the foregoing. In addition, other bulky nitrogen-containing compounds and any poly-nuclear aromatic compounds tend to fill in the adsorption sites, particularly at the relatively low temperature reaction conditions during isomerization reactions.

Basic nitrogen compounds have a tendency to strongly adsorb on the surface and in the pores of the isomerization catalyst. While desorption of these compounds is possible in the isomerization reaction zone, the reaction conditions during isomerization reactions, i.e., relatively low temperature, is less than that required to promote desorption of the nitrogen compounds during reaction, and hence they will "poison" the catalysts under isomerization reaction conditions. Aromatics, such as single ring and polynuclear aromatics including those having 2-4 rings and in hydrocarbon streams approximately at the diesel fraction, adsorb on the isomerization catalyst surface, but are less adsorptive than equivalent aromatic-content nitrogen compounds. That is, the relative adsorption coefficient for aromatic nitrogen-containing compounds is much higher than that of equivalent weight aromatic hydrocarbons. For instance, acridine (a three-ring nitrogen-containing aromatic-ring compound) has a ratio of adsorption constant value of 34 compared to anthracene (a three ring aromatic molecule without nitrogen heteroatoms) with a ratio of adsorption constant value of 0.

Adsorption conditions include temperatures in the range of from about 20° C. to about 400° C., in certain embodiments about 20° C. to about 300° C., and in further embodiments about 20° C. to about 200° C.; pressures in the range of from about 1 bar to about 50 bars, in certain embodiments about 1 bar to about 30 bars, and in further embodiments about 1 bar to about 10 bars; and liquid hourly space velocities (LHSV) in the range of from about 0.1 $h^{-1}$ to about 20 $h^{-1}$, in certain embodiments about 0.5 $h^{-1}$ to about 10 $h^{-1}$, and in further embodiments about 1.0 $h^{-1}$ to about 4 $h^{-1}$.

Suitable adsorbent materials include clays, synthetic zeolite, spent or regenerated refinery catalyst, activated carbon, silica-alumina, titania, porous ion-exchange resins or any material containing acidic sites. In certain embodiments, the solid adsorbent materials include silica, alumina, silica alumina, clay, or activated carbon.

Hydrotreating reaction zone 24 can be operated under mild conditions since sterically hindered sulfur-containing compounds are generally present in relatively low concentrations, if at all, in the combined stream to be desulfurized.

As used herein with respect to the hydrotreating or hydrodesulfurization reaction zone 24, "mild" operating conditions are relative and the range of operating conditions depend on the feedstock being processed. As described above, these conditions are generally an operating temperature of 400° C. and below, a hydrogen partial pressure of 40 bars and below, and a hydrogen feed rate of 500 SLt/Lt and below. In certain embodiments of the process described herein, these mild operating conditions as used in conjunction with hydrotreating a mid-distillate stream, i.e., boiling in the range of from about 180° C. to about 370° C., include: a temperature in the range of from about 300° C. to about 400° C., and in certain embodiments about 320° C. to about 380° C.; a reaction pressure in the range of from about 20 bars to about 100 bars, and in certain embodiments about 30 bars to about 60 bars; a hydrogen partial pressure of below about 55 bars, and in certain embodiments in the range of from about 20 bars to about 40 bars; a LHSV in the range of from about 0.5 $h^{-1}$ to about 10 $h^{-1}$, and in certain embodiments about 1.0 $h^{-1}$ to about 4 $h^{-1}$; and a hydrogen feed rate in the range of from about 100 SLt/Lt to about 500 SLt/Lt, in certain embodiments about 100 SLt/Lt to about 300 SLt/Lt, and in additional embodiments about 100 SLt/Lt to about 200 SLt/Lt.

The hydrotreating zone utilizes hydrotreating catalyst having one or more active metal components selected from the Periodic Table of the Elements Group VI, VII or VIIIB. In certain embodiments the active metal component is one or more of cobalt, nickel, tungsten and molybdenum, typically deposited or otherwise incorporated on a support, e.g., alumina, silica alumina, silica, or zeolites. In certain embodiments, the hydrotreating catalyst used in the first hydrotreating zone, i.e., operating under mild conditions, includes a combination of cobalt and molybdenum deposited on an alumina substrate.

The acid catalyst used in isomerization reaction zone 30 contains a solid acidic component having high acidity in terms of quantity and strength. While a range of acidity levels can be used to achieve the desired isomerization reactions, use of solid acid catalysts with higher acidity promotes undesirable cracking of hydrocarbons, particularly under elevated temperature conditions in isomerization reaction zone 30. It is noted that while quantitative measures for the acidity levels of catalysts vary, a suitable characterization that can be used is described in Hansford et al., "The Nature of Active Sites on Zeolites, VII. Relative Activities of Crystalline and Amorphous Alumino-Silicates", *Journal of Catalysis,* 1969, 13, 316-320, which is incorporated by reference herein. Briefly, the Hansford et al. reference describes a method to determine the rate constants for o-xylene isomerization to p-xylene- and xylene at 260° C. An acidity scale based on the relative first order rate constants was determined. While an in depth discussion is beyond the scope of the present description, the isomerization catalyst for use herein should possess an acidity of at least 15 times more than the acidity of amorphous silica-alumina catalyst at a temperature of 260° C. as determined from the isomerization test detailed in Hansford et al. For example, the rate constant for isomerization at 260° C. of o-xylene over silica alumina catalysts is 3.1, and the rate constant over HY zeolite is 48.8, thus the relative acidity of HY zeolite compared to silica alumina is 48.8/3.1, or 15.7.

Particular solid acid catalysts include one or more of zeolites, molecular sieves, crystalline or amorphous aluminosilicates, aluminophosphates, silicoaluminophosphates, sulfated zirconia, tungstated zirconia, niobic acid, supported heteropolyacids or derivatives thereof, or bulk heteropolyacids or derivatives thereof. In certain embodiments, effective solid acidic components include one or more zeolites or molecular sieves.

In addition, one or more solid acid components, for instance, as noted above, can be combined with a suitable porous binder or matrix material in a ratio of solid acid to binder of less than about 15:1, in certain embodiments less than about 10:1, in additional embodiments less than about 5:1, and in further embodiments about 2:1. The binder or matrix material can be selected from one or more of active and inactive materials such as clays (e.g., montmorillonite and kaolin), silica, and/or metal oxides such as alumina. In certain embodiments, the porous matrix or binder material includes silica, alumina, or kaolin clay. In additional embodiments, an alumina binder material is used.

The isomerization reaction zone 30 can include one or more reactors or reaction zones with one or more catalyst beds of the same or different isomerization catalyst. In certain embodiments, fixed bed reactors are employed. In other embodiments, fluidized beds, ebullating beds, slurry beds, and moving beds can be used.

The isomerization reaction zone 30 is operated under suitable conditions to isomerize at least a portion of the alkyl groups present in sterically hindered sulfur-containing compounds to form more reactive sulfur-containing compound. Targeted sulfur-containing compounds include 4,6-dimethyl-dibenzothiophene. These sterically hindered compounds are typically not desulfurized in hydrotreating reactors under mild conditions. Isomerization reaction zone conditions include temperatures in the range of from about 100° C. to about 400° C., in certain embodiments about 150° C. to about 350° C., and in further embodiments about 200° C. to about 300° C.; pressures in the range of from about 1 bar to about 80 bars, in certain embodiments about 1 bar to about 50 bars, and in further embodiments about 1 bar to about 30 bars; LHSV in the range of from about 0.5 $h^{-1}$ to about 8 $h^{-1}$, in certain embodiments about 0.5 $h^{-1}$ to about 5 $h^{-1}$, and in further embodiments about 0.5 $h^{-1}$ to about 2 $h^{-1}$; and a hydrogen feed rate in the range of from about 100 SLt/Lt to about 1000 SLt/Lt, in certain embodiments about 100 SLt/Lt to about 500 SLt/Lt, in further embodiments about 100 SLt/Lt to about 200 SLt/Lt.

The addition of a flash vessel or fractionating column into the apparatus and process herein that integrates hydrotreating and isomerization reaction zones uses relatively low cost units as well as more favorable operating conditions in the hydrodesulfurization zone, i.e., milder pressure and temperature and reduced hydrogen consumption. Only the fraction boiling at or above the target cut point temperature is subjected to the isomerization reactions to convert the sterically hindered sulfur-containing compounds. Further, in embodiments in which an adsorption zone is used, only the fraction boiling at or above the target cut point temperature is subjected to the adsorption zone. This results in more cost-effective desulfurization of hydrocarbon fuels, particularly removal of the refractory, sterically hindered sulfur-containing compounds, thereby efficiently and economically achieving ultra-low sulfur content fuel products.

Distinct advantages are offered by the integrated hydrotreating apparatus and processes described herein when compared to conventional processes for deep desulfurization of hydrocarbon fuel. For example, in certain conventional approaches to deep desulfurization, the entire hydrocarbon stream undergoes adsorption, isomerization and hydrodesulfurization, requiring unit operations of a capacity suitable for the full feedstream for all processes. Furthermore, undesired side reactions during isomerization reactions that can negatively impact certain desired fuel characteristics are avoided for a portion of the initial feed. In addition, in embodiments in which an adsorption zone is required, operating costs associated with the adsorption of nitrogen-containing and poly-nuclear aromatic compounds from the entire feedstream are decreased as only a portion of the initial feed is subjected to adsorption.

As the herein described example demonstrates, very low severity hydrotreating operating conditions can be applied yet the product still contains less than 10 ppmw sulfur compounds. By separating gas oil into two fractions and treating the heavy fraction containing refractory sulfur compounds in adsorptive and isomerization steps, the hydrotreating unit can be operated under very mild conditions, i.e. hydrogen partial pressures of less than 30 bars, liquid hourly space velocity of 1 $h^{-1}$ and hydrogen feed rate of 300 SLt/Lt. If the same stream is to be treated in a single hydrotreating unit, the pressure and/or catalyst volume must be increased to achieve desulfurization levels as shown herein. For example, a hydrotreating pilot plant study conducted with gas oil derived from Arab light crude oil at 30 bars of hydrogen partial pressure and 350° C., showed the relative catalyst requirement for 500 ppmw and 10 ppmw sulfur gas oil products to be 1 and 4.9, respectively.

EXAMPLE

A gas oil was fractionated in an atmospheric distillation column to divide the gas oil into two fractions: a light gas oil fraction (LGO) that generally contains compounds having their boiling points below 340° C., 92.6 W % yield, and a heavy gas oil fraction (HGO) that generally contains compounds having their boiling points above 340° C., 7.4 W % yield. The properties of gas oil and its fractions are given in Table 3:

TABLE 3

| Property | Unit | Method | Gas Oil (GO) | Light Gas Oil (LGO) | Heavy Gas Oil (HGO) |
|---|---|---|---|---|---|
| Yield | | | 100 | 92.6 | 7.4 |
| Sulfur | W % | D-4294 | 0.72 | 0.625 | 1.9 |
| Density | g/cc | D-4052 | 0.82 | 0.814 | 0.885 |
| Nitrogen | ppmw | D-4629 | 36 | 31 | 96 |
| Cetane Index | | D-976 | | 54.1 | |
| Cetane Number | | D-613 | | 53.3 | |
| Cloud Point | ° C. | D-5773 | | −22 | 12 |
| Flash Point | ° C. | D-93 | | 45.5 | 190 |
| Pour Point | ° C. | D-5773 | | −24.4 | 8.9 |
| 0% | ° C. | D-2887 | 48 | 94 | 304 |
| 5% | ° C. | D-2887 | 138 | 150 | 332 |
| 10% | ° C. | D-2887 | 166 | 173 | 338 |
| 30% | ° C. | D-2887 | 218 | 217 | 347 |
| 50% | ° C. | D-2887 | 253 | 244 | 355 |
| 70% | ° C. | D-2887 | 282 | 272 | 363 |
| 90% | ° C. | D-2887 | 317 | 313 | 379 |
| 95% | ° C. | D-2887 | 360 | 324 | 389 |
| 100% | ° C. | D-2887 | 371 | 343 | 416 |
| Viscosity @ 25° C. | cSt | D-7042 | | 2.295 | 1.192 |
| Viscosity @ 50° C. | cSt | D-7042 | | 1.526 | 7.047 |

The HGO fraction contained benzothiophenes and dibenzothiophenes, with the latter being the most abundant species (~80%) according to a two dimensional gas chromatography analysis. Further analysis by gas chromatography integrated with a mass spectroscopy showed benzothiophenes compounds substituted with alkyl chains equivalent to four and more methyl groups.

The heavy gas oil fraction was treated in an adsorption unit operating under conditions effective to remove the nitrogen compounds, in this case at a temperature of 25° C., a pressure of 1 bar, and a LHSV of 2 $h^{-1}$. Attapulgus clay with surface area of 108 $m^2/g$ and pore volume of 0.392

$cm^3/g$ was used as adsorbent material. The adsorption process yielded 98.6 W % denitrogenized gas oil (e.g., stream 38 in FIG. 2) with 17 ppmw of nitrogen and 1.84 W % of sulfur, and 1.4 W % of reject fractions (e.g., stream 40 in FIG. 2) with 1.29 W % nitrogen.

The substantially nitrogen-free heavy gas oil fraction from the adsorption unit was subjected to isomerization and the hydrodesulfurization. The isomerization unit was operated at a temperature of 300° C., a pressure of 30 bars and a LHSV of 0.5 $h^{-1}$ over zinc-impregnated Y-zeolite catalyst. The refractory sulfur present in the denitrogenized heavy gas oil was isomerized as confirmed by Gas Chromatography equipped with a sulfur chemiluminescence detector.

The combined fraction including light gas oil and the cleaned and isomerized heavy gas oil was hydrotreated in a hydrotreating vessel using an alumina catalyst promoted with cobalt and molybdenum metals at about 20.6 bars of hydrogen partial pressure at the reactor outlet, weighted average bed temperature of 335° C., a LHSV of 1.0 $h^{-1}$ and hydrogen feed rate of 300 liters/liters. The sulfur content of the gas oil was reduced to 10 ppmw. Table 4 shows the mass balance for this process:

TABLE 4

| Name | Flow, Kg/h | Sulfur, ppmw | Nitrogen, ppmw |
|---|---|---|---|
| Gas Oil Feed | 1000.00 | 7200 | *36 |
| Light Gas Oil Fraction | 926.00 | 6300 | 31 |
| Heavy Gas Oil Fraction | 74.00 | 19000 | 96 |
| Denitrogenized Gas Oil | 72.97 | 18400 | 17 |
| Nitrogen rich gas oil | 1.03 | 45000 | 13000 |
| Hydrogen to Isomerization Reactor | 0.62 | | |
| Isomerate | 73.59 | 18400 | 17 |
| Combined gas oil Feed to HDS | 999.59 | 7195 | 30 |
| Hydrogen to HDS | 25.49 | | |
| Clean Gas Oil | 1025.08 | <10 | <1 |

The method and system herein have been described above and in the attached drawings; however, modifications will be apparent to those of ordinary skill in the art and the scope of protection for the invention is to be defined by the claims that follow.

I claim:

1. An apparatus for processing a hydrocarbon feed containing undesired organosulfur compounds comprising:

a fractionating column operable to flash the hydrocarbon feed including an inlet for receiving the hydrocarbon feed, a low boiling temperature outlet for discharging a low boiling temperature fraction containing labile organosulfur compounds, and a high boiling temperature outlet for discharging a high boiling temperature fraction containing refractory organosulfur compounds;

an adsorption zone having an inlet in fluid communication with the high boiling temperature outlet and an adsorption zone outlet for discharging extract having a reduced concentration of nitrogen-containing compounds;

an isomerization reaction zone in fluid communication with a source of hydrogen and the adsorption zone outlet, and an isomerization reaction zone outlet for discharging a high boiling temperature fraction having isomerized compounds with steric hindrance removed, the and isomerization reaction zone containing isomerization catalyst possessing an acidity of at least 15 times more than the acidity of amorphous silica-alumina catalyst at a temperature of 260° C. and is selected from the group consisting of zeolites, molecular sieves, crystalline aluminosilicate, amorphous aluminosilicates, aluminophosphates, silicoaluminophosphates, sulfated zirconia, tungstated zirconia, niobic acid, supported heteropolyacids, derivatives of supported heteropolyacids, bulk heteropolyacids and derivatives of bulk heteropolyacids; and a hydrotreating zone having a hydrogen inlet and an inlet in fluid communication with the isomerization reaction zone outlet and with the low boiling temperature outlet, the hydrotreating zone including a hydrotreating zone outlet for discharging hydrotreated hydrocarbon product.

* * * * *